US006231724B1

(12) United States Patent
Busker et al.

(10) Patent No.: US 6,231,724 B1
(45) Date of Patent: May 15, 2001

(54) THERMAL-DISTORTION-FREE DOCTOR FOR PAPERMAKING

(75) Inventors: Leroy H. Busker; J. Larry Chance, both of Rockton; Jeffrey H. Pulkowski, Roscoe, all of IL (US)

(73) Assignee: Beloit Technologies, Inc., Wilmington, DE (US)

( * ) Notice: Subject to any disclaimer, the term of this patent is extended or adjusted under 35 U.S.C. 154(b) by 0 days.

(21) Appl. No.: 08/164,608

(22) Filed: Dec. 8, 1993

(51) Int. Cl.[7] ..... D21G 3/04

(52) U.S. Cl. ..... 162/281; 34/85; 15/256.51

(58) Field of Search ..... 162/281; 15/256.5, 15/256.51, 25; 34/85

(56) References Cited

U.S. PATENT DOCUMENTS

| | | | | |
|---|---|---|---|---|
| 3,001,296 | * | 9/1961 | Carvill | 34/85 |
| 3,387,317 | | 6/1968 | De Noyer et al. | 15/256 |
| 3,450,098 | | 6/1969 | Williams, Jr. | 118/126 |
| 3,526,017 | | 9/1970 | Kleimola | 15/308 |
| 3,611,471 | | 10/1971 | Meskanen et al. | 15/256 |
| 3,624,860 | | 12/1971 | Grimston et al. | 15/308 |

FOREIGN PATENT DOCUMENTS

| | | |
|---|---|---|
| 1177467 | 7/1959 | (DE) . |
| 2929620 | 7/1979 | (DE) . |

* cited by examiner

*Primary Examiner*—Dean T. Nguyen
(74) *Attorney, Agent, or Firm*—Lathrop & Clark LLP

(57) ABSTRACT

A doctor blade structural support has the form of a hollow structural member of roughly triangular cross-section, one side of the triangular cross-section being substantially tangent to the surface of the dryer roll. A quantity of water is disposed within the hollow structural member and resides on the inside surface of the structural member adjacent to the heated dryer roll surface. The interior of the doctor support structure is sealed from the atmosphere and is evacuated so that the interior of the structure contains only water and water vapor. Heat radiating from the dryer roll surface to the doctor support structure causes water disposed on the inside surface adjacent to the dryer roll to evaporate, thus raising the internal vapor pressure in the sealed interior of the doctor support structure. The water vapor continuously condenses on the inside surfaces of the support structure which are not exposed to radiant heating from the dryer roll. This evaporation and condensation of water within the interior hollow support structure maintains relative temperature uniformity from top to bottom of the support structure. The temperature uniformity in turn leads to a minimizing of thermal distortion caused by the heat transfer between the doctor support structure and the dryer roll.

2 Claims, 2 Drawing Sheets

THERMAL-DISTORTION-FREE DOCTOR FOR PAPERMAKING

FIELD OF THE INVENTION

The present invention relates to papermaking structures which resist thermal distortion in general, and to doctor blade support structures in particular.

BACKGROUND OF THE INVENTION

Paper is manufactured in widths of up to four-hundred inches. The paper web must be uniform across its entire width. The width of the paper web, combined with the requirement for uniformity, means that the components of a papermaking machine must maintain dimensional stability across the width of a paper web.

Components of a papermaking machine where dimensional stability is particularly important include the head box, which must uniformly distribute paper fibers under the fourdrinier paper-forming screen, quarter heads, size press heads, the support beam for induction heaters, and the supporting framework for cross machine scanners, as well as cooled reel drums.

One area where dimensional stability is particularly important is in the support of doctor blades which are used in applying coatings to the web as well as for cleaning roll surfaces and, in the case of the Yankee dryer, removing the dried web from the dryer surface. To function properly, doctor blades must engage the surface of the roll or the surface of the web uniformly over the entire length of the web. A problem associated with thermal distortion of the doctor blade support makes retaining dimensional stability across the width of the papermaking machine difficult. Doctor blades are invariably utilized on heated rolls forming part of a dryer. Thus, the blade and its support structure are inevitably heated by radiative heat transfer from the roll or the overlying web to the exposed surfaces of the doctor support structure. Radiative heat transfer has an effect on only the exposed or illuminated portions of the support structure, thus inducing uneven heating within the structure. This leads to thermal distortion and lack of dimensional stability.

One solution to thermal distortion in the doctor blade support structure is the simple and expedient method of applying steam heating to the structure so that all the surfaces comprising the support structure are held at a uniform temperature by the condensation of steam thereon. However, this process is wasteful of energy and requires constantly supplying and controlling the steam pressure and quality supplied to the doctor blade support structure.

What is needed is a self-contained doctor support structure which prevents thermal gradients from forming within the support structure and is thus structurally stable when used in proximity to heated surfaces.

SUMMARY OF THE INVENTION

The doctor of this invention includes a doctor blade and a doctor structural support which spans the width of the roll used in paper manufacturing. The doctor structural support is positioned above a heated dryer roll. The doctor blade is mounted to the support and extends into engagement with the dryer roll surface for cleaning thereof. The doctor blade structural support has the form of a hollow three-walled structural member of roughly triangular cross-section, one side of the triangular cross-section being closely spaced from and parallel to a plane substantially tangent to the surface of the dryer roll. A quantity of water is disposed within the hollow structural member and resides on the inside surface of the structural member which faces the heated dryer roll surface.

The interior of the doctor support structure is sealed from the atmosphere and is evacuated so that the interior of the structure contains only water and water vapor. Heat radiating from the dryer roll surface to the doctor support structure causes water disposed on the inside surface adjacent to the dryer roll surface to evaporate, thus raising the internal vapor pressure in the sealed interior of the doctor support structure. The water vapor continuously condenses on the inside surfaces of the support structure which are not exposed to radiant heating from the dryer roll. This evaporation and condensation of water within the interior hollow support structure maintains relative temperature uniformity from top to bottom of the support structure. The temperature uniformity in turn leads to a minimizing of thermal distortion caused by the heat transfer between the doctor support structure and the dryer roll.

The apparatus disclosed herein can more generally be used wherever thermal distortion is a problem in a papermaking machine. In general, support structures subject to thermal distortion can be formed with hollow interiors which communicate with all portions of the structure subject to thermal distortion. A liquid can be retained on the surfaces of the support structure which receives heating, the interior of the support structure being evacuated so that only the liquid and its vapor are present in the interior void. The liquid is chosen for a particular application depending on the temperature extremes to which the support structure is exposed.

Examples of other papermaking equipment which could benefit from this apparatus for preventing thermal distortion include a paper forming head box, coater heads, size press heads, support beams for induction heaters, supporting frames for cross machine scanners, and cooled reel drums. The above list is not to be considered exhaustive, but the apparatus disclosed herein can be used anywhere in a papermaking machine where thermal uniformity needs to be maintained.

It is an object of the present invention to provide a doctor and doctor support structure which are less sensitive to thermal distortion.

Further objects, features and advantages of the invention will be apparent from the following detailed description when taken in conjunction with the accompanying drawings.

DESCRIPTION OF THE PREFERRED EMBODIMENTS

Figure 1:
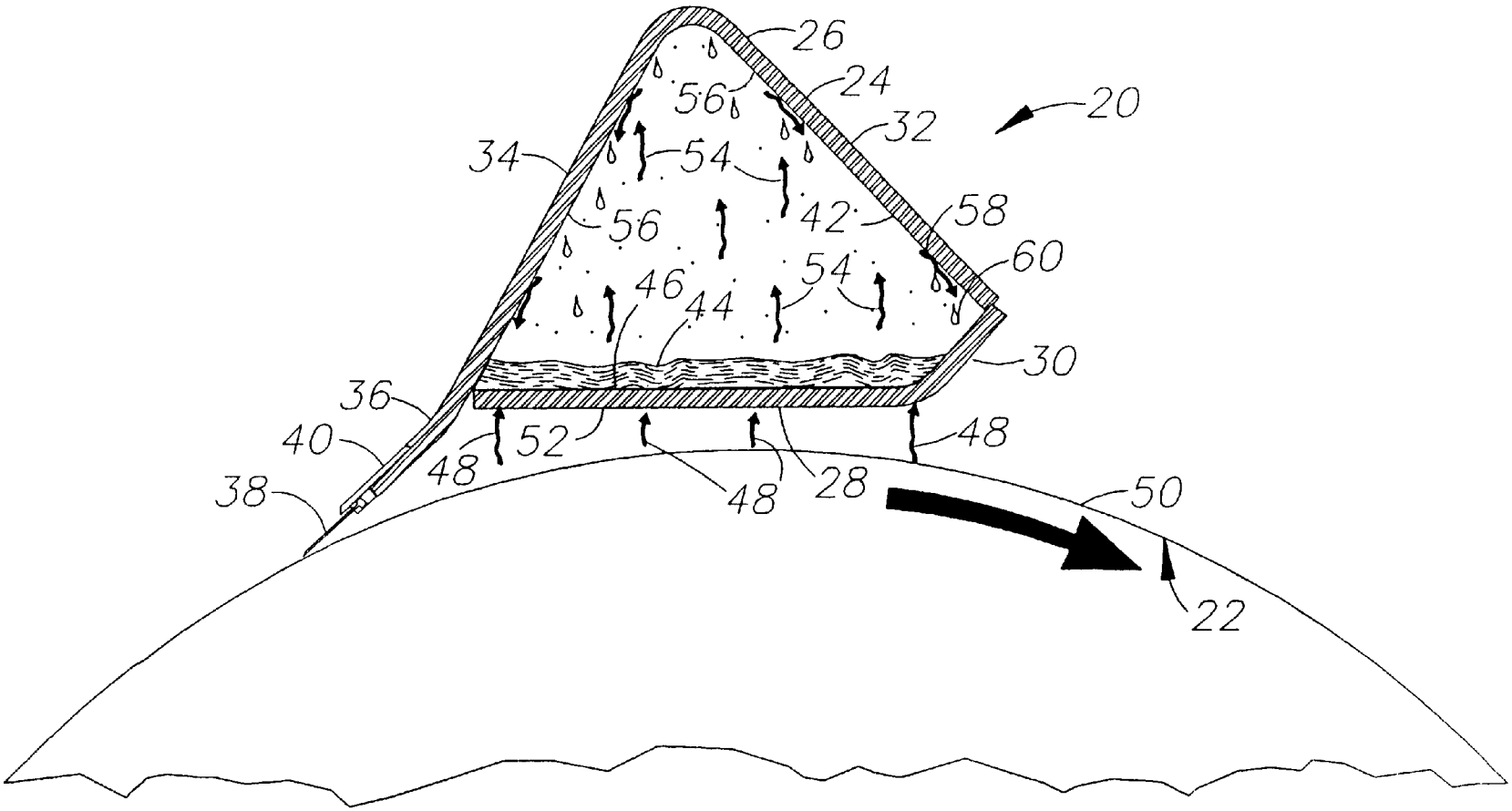
FIG. 1 is a schematic, cross-sectional view of the paper doctor of this invention.
Figure 2:
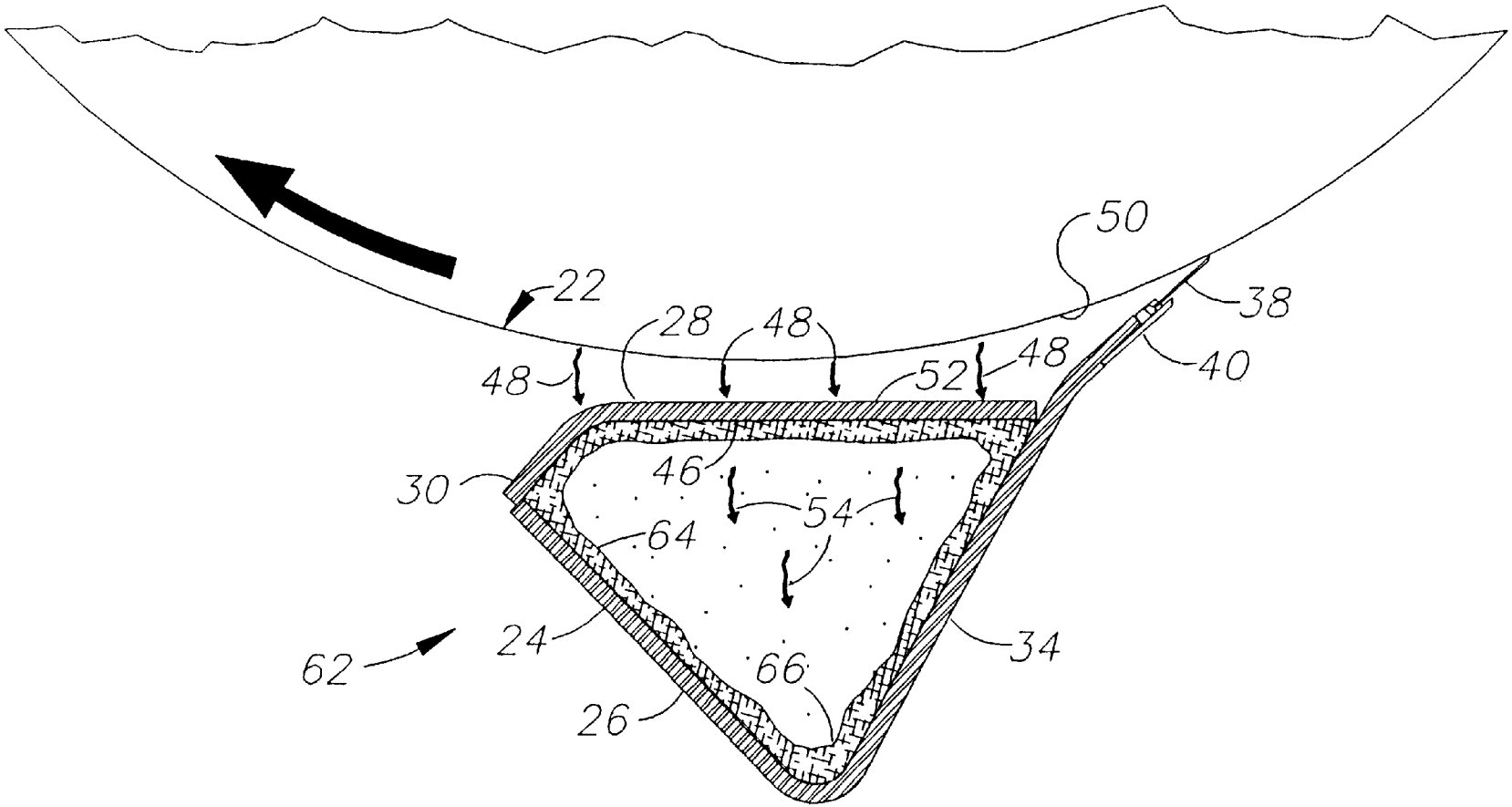
FIG. 2 is an alternative embodiment of the doctor of this invention.

Referring more particularly to FIGS. 1 and 2, wherein like numbers refer to similar parts, a doctor 20 is shown in FIG. 1. The doctor 20 is positioned over a dryer roll 22 and employs a structural support 24. The structural support 24 has a somewhat triangular cross-section 26. The structural cross-section 26 is formed by a bottom wall 28, a side flange 30, a first upper side wall 32 and a second upper side wall 34. The second upper side wall 34 has a downward extension 36 to which a doctor blade 38 is mounted by a clamping mechanism 40. The interior void 42 of the structural member 24 is sealed from the atmosphere. A quantity of liquid water 44 is disposed along the inside surface 46 of the bottom wall 28.

The structural support member 24 is heated by radiant heat transfer indicated by arrows 48 from the surface 50 of the heated dryer roll 22. The radiant heat is absorbed at the bottom surface 52 of the bottom wall 28, where it is conducted to the interior surface 46, where it heats the water 44. Heating the water 44 causes it to evaporate. This increases the vapor pressure of water in the interior void 42 of the doctor support structure 24. The water vapor indicated by arrows 54 travels towards the cooler upper side walls 32, 34 which are shaded from the thermal radiation by the bottom wall 28 and side flange 30. Contacting the inside surfaces 50, 56 of the upper side walls 32, 34, the water vapor condenses. The condensation, shown by arrows 58, flows along the side walls 32, 34 and drops 60 flow toward the bottom wall 28, rejoining the water 44 retained on the lower surface 46 of the hollow structural member 24 above the bottom wall 28.

The use of an evaporating and condensing liquid for heat transfer is a particularly efficient way of moving heat. This is because little or no heat gradient is required for the heat transport. Evaporation is a constant temperature process which absorbs heat from the water 44. This in turn cools the bottom wall 28. On the other hand, condensation is a constant temperature process which liberates heat. Thus, the condensing water supplies heat to the upper side walls 32, 34 at a temperature which is nearly equal to the temperature at which the heat is given up on the bottom wall 28. Thus, heat transfer within the sealed structural support 24 reduces or eliminates temperature gradients across the structural support 24.

In the absence of the heat transfer mechanism described herein, the bottom wall 28 would increase in temperature relative to the upper side walls 32, 34. Increase in temperature is accompanied by an expansion of the material from which the structural member 24 is composed. The expansion of the bottom wall 28 with respect to the upper side walls 32, 34 results in an outward bowing of the support structure which tends to cause the doctor blade 38 to press excessively hard in the center of the roll and not fully engage the roll on the edges.

An experiment was performed involving a twelve inch square steel tube which was used to simulate the doctor structural support 24. When one side of the steel beam was heated in a way to simulate the heating caused by the dryer roll 22, a temperature gradient of one-hundred degrees developed between the bottom and the top of the square tube. When a quantity of water was introduced into the interior of the tube disposed along the surface being heated, the tube was sealed from the atmosphere and evacuated so that the tube interior contained only water and water vapor. When the tube was again heated in the same way as previously, the temperature gradient across the beam was reduced to ten degrees.

Although fluids other than water might be used in the interior 42 of the structural member 24 of the doctor 20, water is advantageous due to its low cost and lack of safety concerns.

FIG. 2 illustrates conceptually an application of this invention to a doctor 62 which is positioned beneath the dryer roll 22 where gravity is not available to move condensation to the bottom wall 28 of the doctor structural support 24. Here an internal wick 64 lines the inside surface 56 of the hollow support structure 24. The wick would be wetted with a liquid 66.

It should be understood that while the doctor support element 22 will normally be fabricated of structural steel, it could be fabricated of aluminum, other alloys, or structural composites.

It should also be understood that wherein water is shown and described as the fluid contained in the interior of the support structure 24, other fluids which may safely be employed in an industrial setting could be used.

It should also be understood that wherein the support structure 24 is shown supporting a doctor blade 38, the structure could be used to support other apparatus which must be positioned in close proximity to a heated dryer roll surface or the like. This would include, but is not limited to, cross machine scanners, support for induction heaters, coater heads, size press heads, and cooled reel drums.

It should be understood that the invention is not confined to the particular construction and arrangement of parts herein illustrated and described, but embraces such modified forms thereof as come within the scope of the following claims.

Additionally, although the present invention has been particularly described with reference to a doctor, it will be apparent to those skilled in the art that the present invention is also applicable to any cross-machine structure requiring thermal stabilization.

What is claimed is:

1. An apparatus for use in papermaking comprising:

a heated roll for supporting and drying a paper web, the roll having a cylindrical surface;

a support member spanning the length of the roll, the support member having portions defining an interior void extending the length of the support member, the void being sealed and defining an interior surface;

a quantity of liquid contained within the void; and a blade fixedly supported on the support member, wherein the blade substantially spans the length of the roll, and wherein the blade is biased against the roll surface, and wherein the support member remains at a substantially uniform temperature in response to changes in phase of the liquid, which is heated by the roll, and wherein despite non-uniform heating the support member provides uniform support immune to thermal-induced distortion, the arrangement being such that heat radiating from the heated roll surface to the support member causes the liquid disposed on the interior surface adjacent to the heated roll surface to evaporate, thus raising the internal vapor pressure in the interior void of the support structure, the vapor continuously condensing on the interior surface of the support structure not exposed to radiant heating from the heated roll so that the evaporation and condensation of the liquid within the interior void maintains relative temperature uniformity along the support member, thereby minimizing thermal distortion caused by heat transfer between the support member and the heated roll.

2. The apparatus of claim 1 wherein the liquid contained within the void comprises water.

* * * * *